US009644561B2

(12) United States Patent
Magner et al.

(10) Patent No.: US 9,644,561 B2
(45) Date of Patent: May 9, 2017

(54) SYSTEM AND METHOD TO RESTORE CATALYST STORAGE LEVEL AFTER ENGINE FEED-GAS FUEL DISTURBANCE

(71) Applicant: Ford Global Technologies, LLC, Dearborn, MI (US)

(72) Inventors: Stephen William Magner, Farmington Hills, MI (US); Mrdjan J. Jankovic, Birmingham, MI (US); Imad Hassan Makki, Dearborn Heights, MI (US); James Michael Kerns, Trenton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 656 days.

(21) Appl. No.: 14/011,630

(22) Filed: Aug. 27, 2013

(65) Prior Publication Data

US 2015/0066336 A1 Mar. 5, 2015

(51) Int. Cl.
*F02D 41/14* (2006.01)
*F02D 41/02* (2006.01)

(52) U.S. Cl.
CPC ..... *F02D 41/1454* (2013.01); *F02D 41/0295* (2013.01); *F02D 41/1441* (2013.01); *F02D 41/1482* (2013.01); *F02D 41/1483* (2013.01); *F02D 2041/1412* (2013.01); *F02D 2041/1419* (2013.01)

(58) Field of Classification Search
None
See application file for complete search history.

(56) References Cited

U.S. PATENT DOCUMENTS

| | | | | |
|---|---|---|---|---|
| 5,183,128 | A * | 2/1993 | Ito | B60K 28/16 180/197 |
| 5,225,982 | A * | 7/1993 | Ito | B60K 28/16 123/361 |
| 6,155,242 | A | 12/2000 | Kotwicki et al. | |
| 6,785,601 | B2 | 8/2004 | Yoshizawa et al. | |
| 7,006,909 | B1 * | 2/2006 | May | F02D 41/1401 701/102 |
| 7,389,773 | B2 | 6/2008 | Stewart et al. | |
| 7,742,870 | B2 | 6/2010 | Yoshikawa | |
| 7,844,388 | B2 | 11/2010 | Perschl et al. | |
| 7,987,840 | B2 | 8/2011 | Magner et al. | |

(Continued)

OTHER PUBLICATIONS

Jankovic, Mrdjan J. et al., "Bias Mitigation for Air-Fuel Ratio Sensor Degredation," U.S. Appl. No. 13/764,643, filed Feb. 11, 2013, 35 pages.

*Primary Examiner* — Hung Q Nguyen
*Assistant Examiner* — Brian P Monahon
(74) *Attorney, Agent, or Firm* — Julia Voutyras; McCoy Russell LLP

(57) ABSTRACT

Various approaches are described for air-fuel ratio control in an engine. In one example, a method include adjusting fuel injection from an anticipatory controller responsive to exhaust oxygen feedback of an exhaust gas sensor positioned upstream of an exhaust catalyst, the anticipatory controller including a first integral term and a second integral term, the second integral term correcting for past fuel disturbances. In this way, it is possible to provide fast responses to errors via the anticipatory controller, while corrected known past fueling errors, on average, via the second integral term.

17 Claims, 8 Drawing Sheets

(56) References Cited

U.S. PATENT DOCUMENTS 8,145,409 B2 3/2012 Kerns et al.
2003/0017603 A1* 1/2003 Uchida ..... B01D 53/9495 436/37
2004/0133335 A1* 7/2004 Nakano ..... F01N 3/023 701/103
2004/0244363 A1* 12/2004 Makki ..... F01N 11/007 60/285
2004/0244364 A1* 12/2004 Makki ..... F01N 11/002 60/285
2004/0249556 A1* 12/2004 Makki ..... F01N 11/005 701/114
2006/0122761 A1* 6/2006 Yasui ..... F01L 1/34 701/102
2007/0125069 A1* 6/2007 Storhok ..... F01N 11/00 60/285
2007/0125070 A1* 6/2007 Storhok ..... F01N 3/0842 60/285
2007/0256406 A1* 11/2007 Makki ..... F01N 11/007 60/277
2008/0147297 A1* 6/2008 Nakagawa ..... F02D 41/1441 701/103
2008/0148712 A1* 6/2008 Wada ..... F01N 3/0814 60/285
2008/0295488 A1* 12/2008 Takubo ..... F02D 41/0295 60/276
2011/0132341 A1* 6/2011 Magner ..... F02D 41/047 123/703
2011/0146238 A1* 6/2011 Rodatz ..... F02D 41/1401 60/274
2011/0295491 A1* 12/2011 Kurahashi ..... F02D 41/0085 701/103
2012/0037134 A1* 2/2012 Jankovic ..... F02D 41/0002 123/568.21
2012/0290192 A1* 11/2012 Okazaki ..... F02D 41/1454 701/103

* cited by examiner

SYSTEM AND METHOD TO RESTORE CATALYST STORAGE LEVEL AFTER ENGINE FEED-GAS FUEL DISTURBANCE

BACKGROUND AND SUMMARY

Engines may combust a mixture of air and fuel to generate torque. A ratio of air to fuel, referred to as the air-fuel ratio or fuel-air ratio, may be controlled responsive to feedback from various sensors, including exhaust gas oxygen sensors. Closed loop control of the engine air-fuel ratio may be composed of several control loops: an inner loop that seeks to regulate the exhaust gas before it passes through an emission reducing catalyst, and an outer loop that uses measurements of the gas after it passed through the catalyst.

The inner loop control may have several control objectives, including maintaining the feed-gas (engine out) air-fuel ratio to reduce emissions, reduce fuel economy losses, and reduce NVH or drivability issues. Additionally, the inner loop may aim to regulate the feed-gas fuel-air ratio to track a target value set by operating conditions such as engine speed, load, temperature, etc., and modified by the outer loop feedback. The outer loop may operate to adjust the inner loop fuel-air ratio target based on post catalyst sensor readings that indicates the catalyst state. The outer loop feedback control faces various challenges predominantly due to a long delay before any feed-gas change at the input of the catalyst is seen at the output and measured by the HEGO sensor.

It has been proposed to augment the inner loop to address large propagation delays and dynamic lags that exist in the combustion/exhaust system, such as described in U.S. Pat. No. 7,987,840). Additionally, an additional integral term can be added to a standard proportional-integral (PI) controller used in the inner loop to track disturbances that were not rejected upstream of the catalyst. The tracking integrator can be placed into the controller structure (for example in series with the original integrator); however this will lead to conflicts if an anticipatory controller (e.g., a delay compensator such as a Smith Predictor), is used.

The inventors have recognized the above-described disadvantages and, in embodiments provide an engine method, comprising adjusting fuel injection from an anticipatory controller responsive to exhaust oxygen feedback of an exhaust gas sensor positioned upstream of an exhaust catalyst, the anticipatory controller including a first integral term and a second integral term, the second integral term correcting for past fuel disturbances.

In this way, it is possible to more accurately maintain the fuel-air ratio entering the exhaust catalyst at stoichiometry on average over time, by cancelling previous errors with later corrections. Normally such corrections are countered by the anticipatory controller. However, by placing an additional integrator in the inner loop in a reference location of the anticipatory controller, the time-integrated average air-fuel ratio in the exhaust catalyst can be controlled even in the presence of one-sided (e.g., asymmetric) disturbances. Additionally, the additional integrator may be clipped based on engine torque disturbance limits and based on whether the exhaust catalyst is, or is about to be, saturated with stored oxygen, or depleted of stored oxygen.

In one particular example, the method may structure the inner loop controller to track a ramp type input, which may be effective in dealing with the above-mentioned fuel disturbance problems. The additional integrator term integrates the error and adds this to the controller output so as to counteract disturbances that have already occurred, as long as the catalyst is operated in a non-saturated state. As such, the challenges to the outer loop control are reduced by action the inner loop controller takes to keep the catalyst oxygen storage within a desired range. Specifically, it is possible to deal with fueling disturbances that occur by altering the reference set point to make up for the disturbance over a period of time. By countering this known disturbance soon after it occurs while still enabling predictive controller action, the impact on the catalyst is reduced, making outer loop control less difficult.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION

Figure 1:
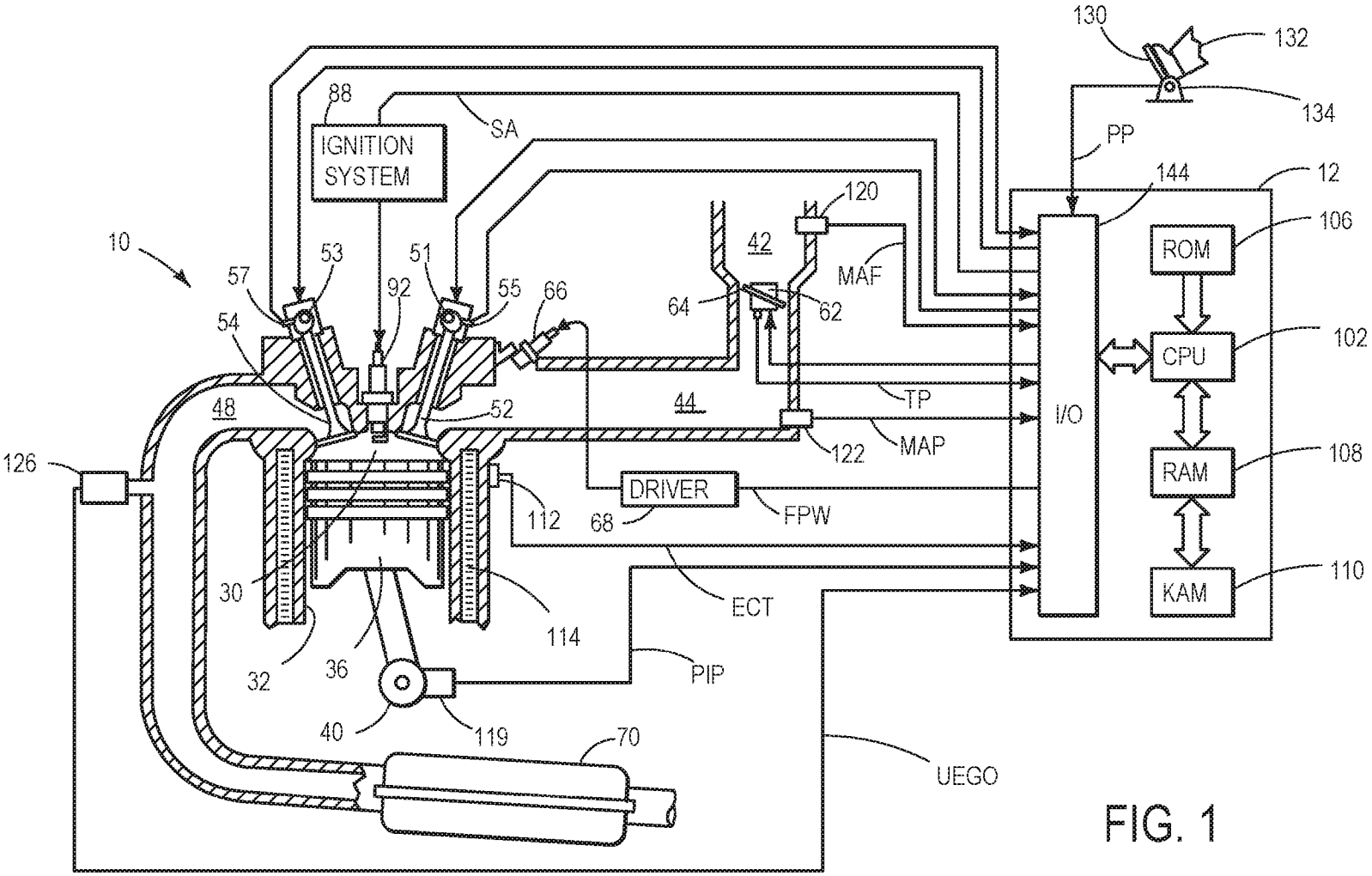
FIG. 1 shows an example cylinder of an internal combustion engine.
Figure 2A:
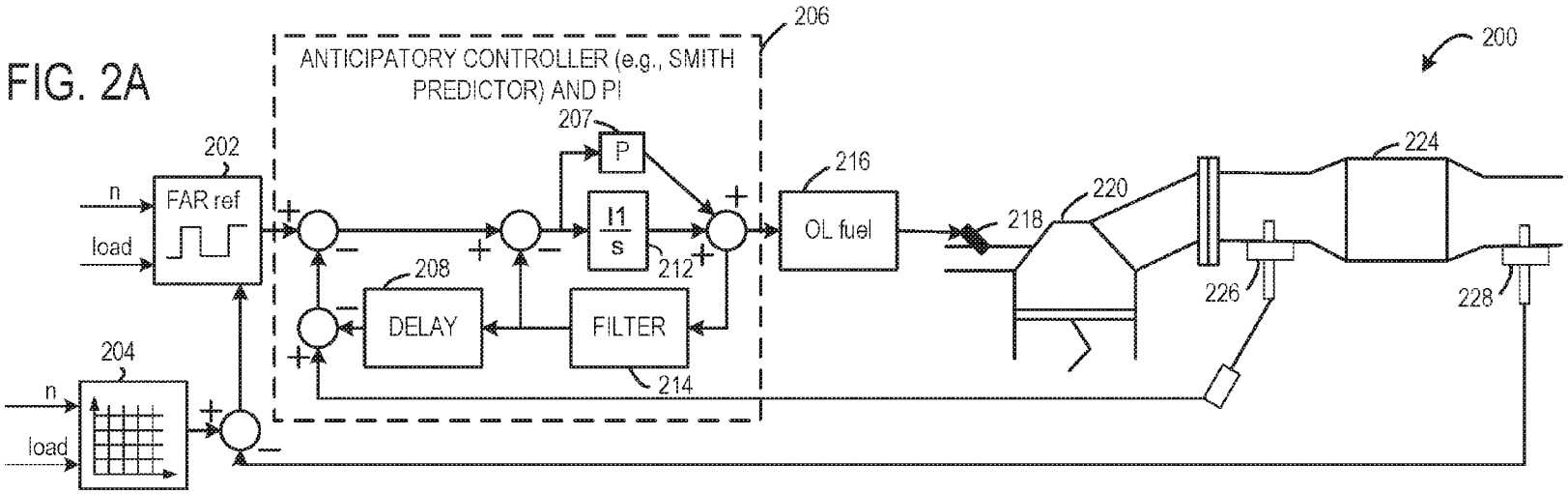
FIG. 2A shows a diagram of an example delay compensated PI controlled fuel system.
Figure 7:
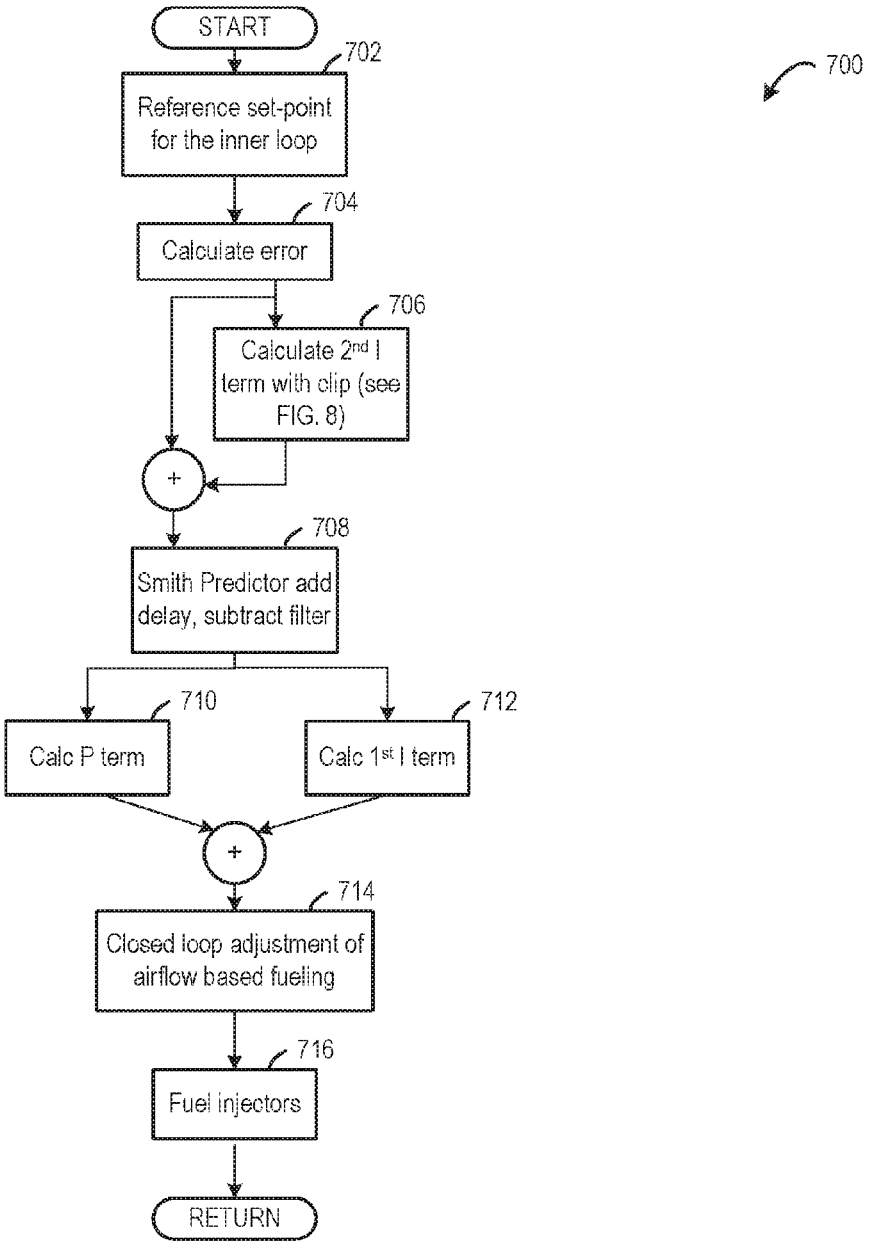
FIG. 7 shows a flow chart of a method in accordance with the present disclosure.
Figure 8:
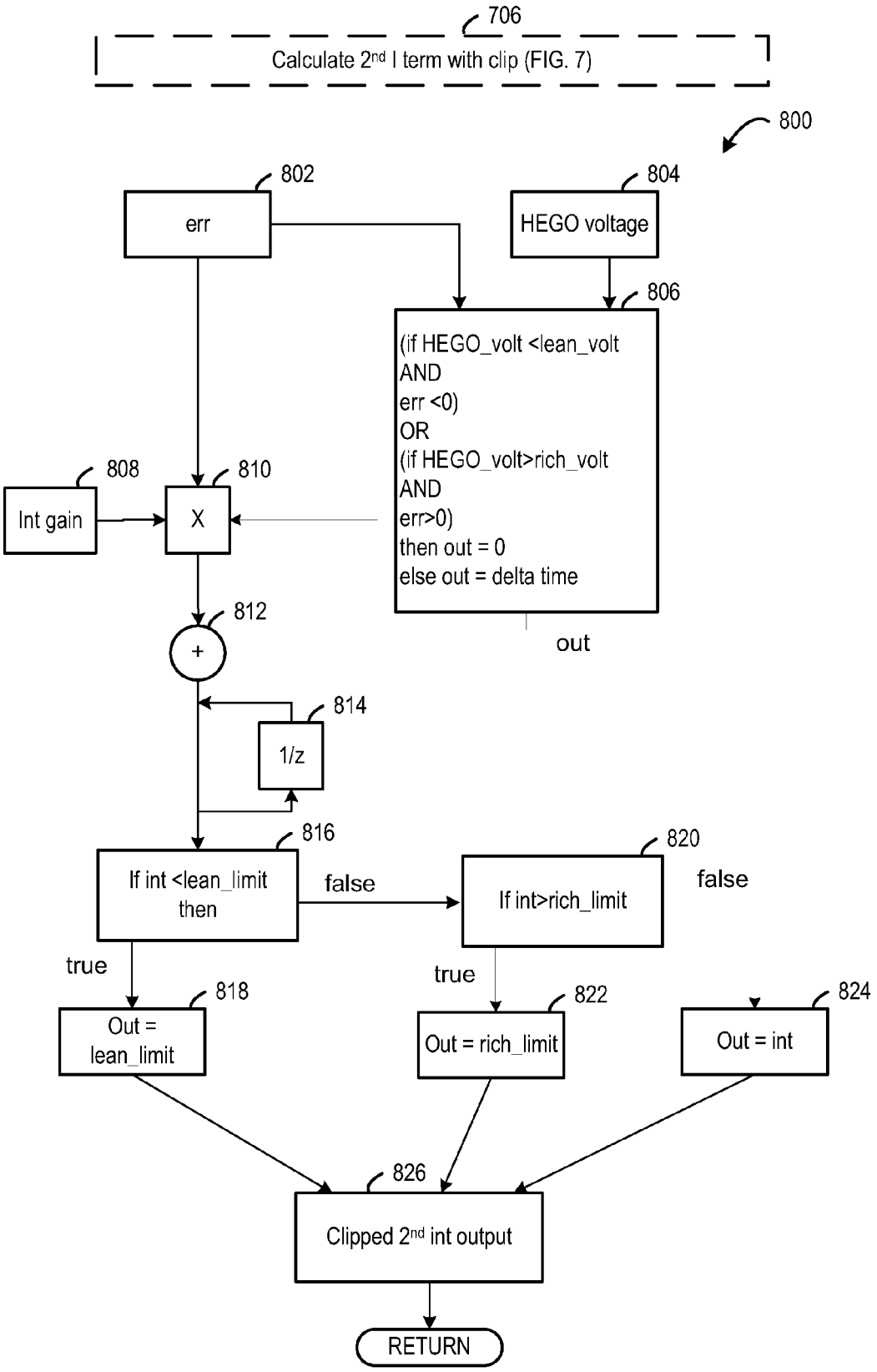
FIG. 8 shows a flow chart of the clipping steps for the I2 integrator.

The present disclosure related to internal combustion engine fuel control to maintain catalyst oxygen storage, using an inner fuel control system feedback loop and an outer control loop. In embodiments, the fuel control system incorporates an additional integrator term. The additional integrator is based on a reference signal as well as feedback from an exhaust gas oxygen sensor upstream of an exhaust catalyst. The additional integrator mitigates unanticipated fuel disturbances. FIG. 1 shows an example cylinder of an engine in accordance with the present disclosure. FIG. 2A shows a first method of feedback controlling a fuel system, which is contrasted against a block diagram of the fuel system with an additional integrator, shown in FIG. 2B. FIGS. 3-6 show experimental outputs of various operations of the fuel control system according to the structure of FIG. 2. FIGS. 7 and 8 show flowcharts detailing example methods using the additional integrator with an anticipatory controller in the context of a control system with an inner and outer loop controlling a catalyst oxygen storage state to a reference level.

FIG. 1 is a schematic diagram showing one cylinder of multi-cylinder engine 10, which may be included in a propulsion system of a vehicle in which an exhaust gas sensor 126 may be utilized to determine an air-fuel ratio of exhaust gas produced by engine 10. The air fuel ratio (along with other operating parameters) may be used for feedback control of engine 10 in various modes of operation as part of an air-fuel control system. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake passage 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Air-fuel ratio exhaust gas sensor 126 is shown coupled to exhaust passage 48 of exhaust system 50 upstream of emission control device 70. Sensor 126 may be any suitable sensor for providing an indication of exhaust gas air-fuel ratio such as a linear oxygen sensor or UEGO (universal or wide-range exhaust gas oxygen). Other embodiments may include different exhaust sensor such as a two-state oxygen sensor or EGO, a HEGO (heated EGO), a NOx, HC, or CO sensor. In some embodiments, exhaust gas sensor 126 may be a first one of a plurality of exhaust gas sensors positioned in the exhaust system. For example, additional exhaust gas sensors may be positioned downstream of emission control 70.

Emission control device 70 is shown arranged along exhaust passage 48 downstream of exhaust gas sensor 126. Device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 142, input/output ports 144, an electronic storage medium for executable programs and calibration values shown as read only memory chip 146 in this particular example, random access memory 148, keep alive memory 150, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Furthermore, at least some of the above described signals may be used in the air-fuel ratio, or fuel-air ratio (FAR) control systems and methods described in further detail below. For example, controller 12 may be configured to adjust fuel injection to the engine with a first control structure responsive to feedback from the air-fuel ratio sensor as well as other sensors. Further, the controller 12 may be configured to utilize sensor feedback to determine air-fuel sensor degradation, such as an asymmetric degradation. In some examples, the controller 12 may include instructions non-transitorily stored in memory for controlling engine operation, including adjusting fuel injection from an anticipatory controller, such as a Smith Predictor, responsive to exhaust oxygen feedback of an exhaust gas sensor positioned upstream of an exhaust catalyst, the anticipatory controller including a first integral term and a second integral term, the second integral term correcting for past fuel disturbances. The second integral term can assist in maintaining, through fuel injection adjustments, exhaust fuel-air ratio entering the exhaust catalyst to be stoichiometric over a time-integrated average, even responsive to a one-sided disturbance. In some embodiments, the controller includes instructions for clipping the second integral term based on engine torque correction limits, and suspending fuel corrections generated by the second integral term based on exhaust gas oxygen sensor readings downstream of the exhaust catalyst, the fuel correction suspended responsive to the downstream exhaust gas oxygen sensor reading is already biased from stoichiometry in the same direction as corrections generated by the second integral term. Further, the controller may include instructions executable to adjust a reference set-point of the anticipatory controller responsive to engine speed and load, wherein an inner loop reference set-point is modulated at a frequency, and where the reference is a desired catalyst oxygen storage state between fully saturated with oxygen and fully depleted with oxygen.

In some examples, the controller 12 may include instructions non-transitorily stored in memory for controlling engine operation, including adjusting fuel injection via fuel controller comprising an anticipatory controller responsive to exhaust oxygen feedback of an exhaust gas sensor positioned upstream of an exhaust catalyst, the anticipatory controller including a first integral term in the anticipatory controller and a second integral term, the second integral term correcting for past fuel disturbances, an output of the second integral term only partially forming a reference set-point of the anticipatory controller.

Note storage medium read-only memory 106 can be programmed with computer readable data representing instructions executable by processor 102 for performing the methods described herein as well as other variants.

Figure 2B:
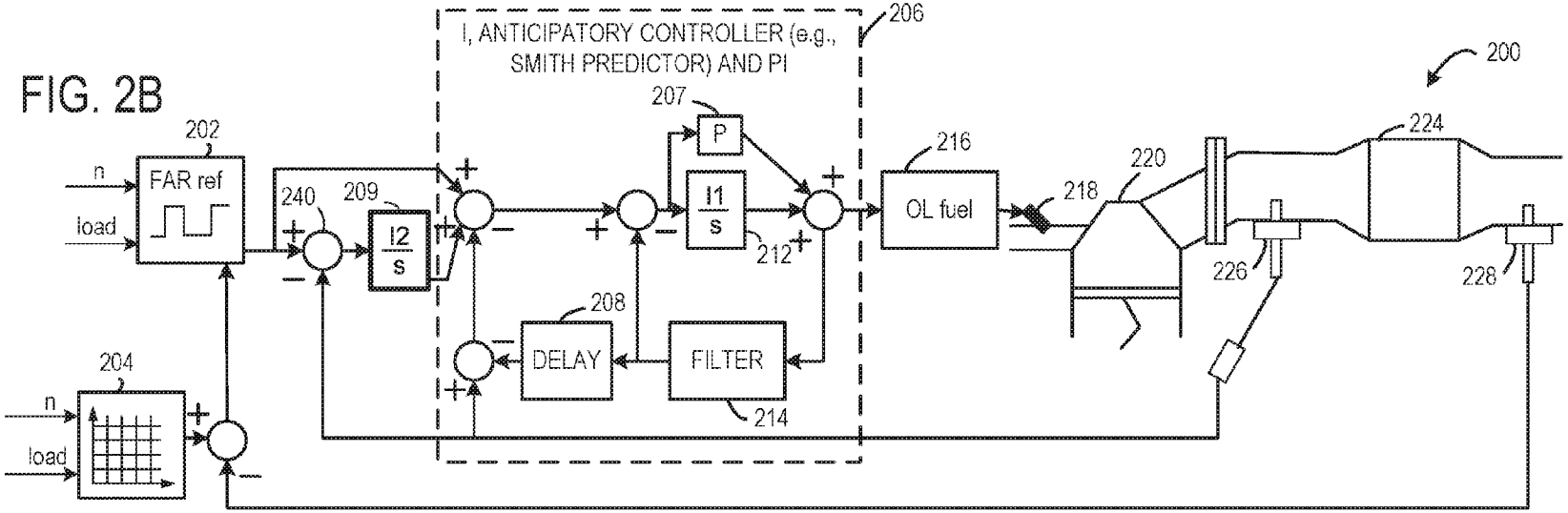
FIG. 2B shows a block diagram of an inner loop fuel control system according to an example embodiment of the present disclosure with an additional integrator (I2).

Example control block diagrams of controllers that may be included in controller 12 are shown FIGS. 2A and 2B.

Turning now to FIG. 2A, a block diagram is shown of an example inner and outer closed loop control with the physical system (referred to as the plant) rendered as mechanical components. The FAR REF block 202 represents the reference fuel-air ratio set-point command that in these examples is a square wave that varies fuel command about stoichiometry at a selected frequency, such as between 0.5 and 3 HZ. Input to the reference block 202 includes engine speed and load. Small and frequent command changes improve efficiency of the catalyst 224. Selection of the square wave's amplitude, period, and duty cycle may be functions of engine operating parameters such as engine speed (n), load, various temperatures, etc. Further, the square wave may be adjusted based on a measured indication of catalyst state, corresponding to exhaust gas oxygen sensor voltage after the catalyst (determined by HEGO sensor 228), relative to a HEGO set point, again typically a function of various engine parameters determinable by a lookup table 204.

Inside the fuel control system block 206 is the inner loop controller which, in this example, includes a Smith Predictor that uses estimates of the combustion/exhaust delay 208 and filter lag 214 to compensate a PI controller 207, 212 to allow for higher gains with stable operation. The next block provides an abstraction of the remaining control strategy involved in fueling such as open loop (OL) fuel 216 that converts air mass into fuel injection commands sent to fuel injector 218, but is fine tuned based on the feedback fuel control. The remaining elements in the diagram indicate the relevant physical system that is under control (injector 218, combustion cylinder 220, exhaust UEGO sensor 226, catalyst 224, and HEGO sensor 228, which may correspond to the example engine system of FIG. 1, including injector 66, combustion chamber 30, sensor 112, etc.).

This controller corrects errors by reacting to a reference signal minus feedback measurement (referred to as an error signal). A reference change or a disturbance to the system will create an error. Once the error is removed, the non-memory portion of the controller (example: proportional term 207) provides no further correction. Memory type control terms (example: integral term 212) will continue to provide a correction once the error is zero; however the correction will be a fixed offset until a new error occurs. This allows a regulator to control a system that has a steady state disturbance imposed on it such as a load. A disturbance that was not immediately rejected by the regulator is not later corrected. In many cases it would be of little value or possibly detrimental to deliberately make an opposite disturbance (in effect what the correction would be if made once the transient response subsides) to counter a disturbance that has already occurred in the past. However, the inventors herein have recognized that in cases where the system downstream of our sensor is itself sensitive to a cumulative effect of the disturbance (the catalyst is such a system), it may be beneficial to counter a past disturbance to maintain the system's desired equilibrium. Complicating matters, however, is the anticipatory nature of the predictive controller (e.g., the Smith Predictor).

Specifically, even with the Smith Predictor in the loop, disturbances in terms of excess oxidants or excess reductants may still pass through and go into the catalyst. Furthermore, the catalyst acts as an accumulator (oxygen storage device) with saturation limits. Counteracting any known disturbances that have already passed, as determined by the UEGO sensor, may be effective in centering the catalyst oxygen storage to an intermediate value and away from the storage limits. However, such corrections can negatively interact with the predictive controller, either resulting in failure to fully reject the left over error, or generating controller instabilities that can lead to even greater errors. For example, adding an additional integrator in series with the controller integrator in a conventional PI structure can negatively interact with the delay compensator and fail to reject the left over error.

An example approach to address the fuel disturbances of prior fuel control methods, while reducing negative interactions with a predictive controller, is to place the extra integrator before the entire Smith Predictor structure in the control architecture (e.g., configure the controller such that the additional integrator is used to generate at least part of, and in one example, only part of, the reference set-point for the predictive controller). One example of this approach is illustrated in FIG. 2B. Therein, the reference signal is fed to both the original location to be processed by the Smith Predictor and PI (P 207 and I1 212) controller, but it also is independently used to calculate an error term for the second integrator (I2/s) shown at 209, where "s" is the Laplace operator. This method is referred to here as the I&PI method. The Smith Predictor has no direct influence on the error that I2/s uses, and thus negative interactions among the two integrators is reduced. In other words, the additional integrator (I2/s) does not depend on the Smith Predictor, but it is dependent on the reference signal from the outer loop.

In this way, it is possible to adjust fuel injection via an anticipatory controller (e.g., the Smith Predictor) responsive to exhaust oxygen feedback of an exhaust gas sensor positioned upstream of an exhaust catalyst, the anticipatory controller including a first integral term 212 (which in this example forms a part of the Smith Predictor) and a second integral term 209, the second integral term correcting for past fuel disturbances. The second integral term maintains exhaust fuel-air ratio entering the exhaust catalyst to be stoichiometric over a time-integrated average, even responsive to a one-sided disturbance. This system may be implemented in the context of an inner and outer loop feedback control system, such as shown in FIG. 2B. The outer loop reference generated by 204 may be responsive to engine speed and load, setting a reference voltage for the downstream air-fuel ratio sensor 228. The inner loop reference generated by 202 may also be based on engine speed and load, and may represent a catalyst oxygen storage state. The inner loop reference may be modulated at a frequency as described herein.

Additional features may be added to the controller of FIG. 2B, as described in further detail herein with regard to FIGS. 7-8, including clipping the second integral term based on engine torque correction limit, and suspending fuel corrections generated by the second integrator based on downstream exhaust gas oxygen sensor readings.

Figure 3:
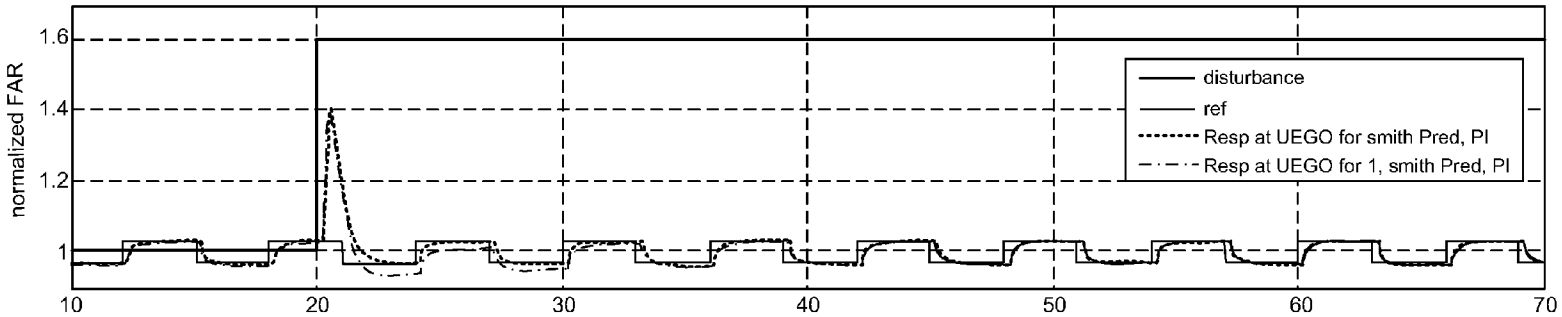
FIG. 3 shows system responses to the fuel control systems shown in FIGS. 2A and 2B.
Figure 3:
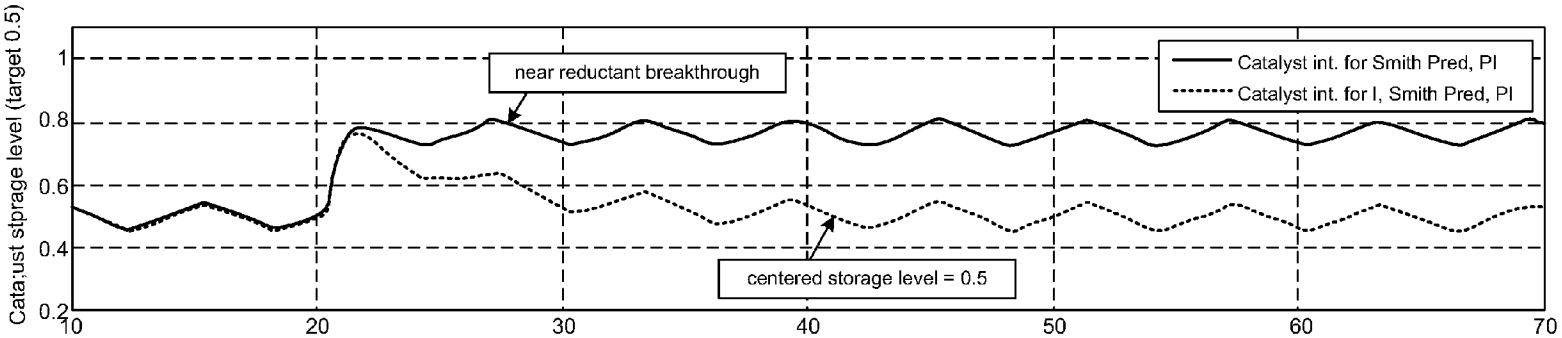

Turning now to FIG. 3, a simulation result is shown. It illustrates how the controllers of FIGS. 2A and 2B, respectively, respond to a square wave reference command (light solid line) and an imposed fuel disturbance at 20 seconds (heavy solid tract). In the upper plot, the system's responses (dotted line: Smith Predictor and PI; and dashed-dotted line: additional integrator before the Smith Predictor junction) reject the persistent 0.6 phi (normalized fuel-air ratio) disturbance within 2 seconds. However, the catalyst storage has been altered rich (excess reductants) from its intended state (shown in the lower plot of FIG. 3) during the 2 second excursion. By tracking this change with the added integrator I2/s, it is possible to slowly restore the catalyst state to its intended balanced level, the dashed-dotted line.

The magnitude of the disturbance correction may be taken into account to avoid undesired engine torque disturbances. The engine torque output is reduced if the FAR is reduced (lean: too little fuel). This may become noticeable if the mixture is 3% or more lean. The control action of the controller of FIG. 2A can be potentially larger because the control action is typically countering a rich disturbance. The second integrator, however, will be acting after the transient has subsided, in order to keep the catalyst centered, but not necessarily benefiting the upstream combustion. Therefore, to make the control more robust, a lean correction limit may be imposed on the second integrator, as described further with regard to FIGS. 7-8, which can operate in coordination with the controller of FIG. 2B. Further, rich controller reactions can be clipped as well, but from a torque disturbance perspective, could be allowed to take larger values as torque is not reduced at the same rate as lean excursions of the same magnitude.

Note that various approaches can be taken to clip the second integrator. In one example, the second integrator's output may be clipped based on the feed-gas UEGO value. If too lean, the second integrator's output can be reduced or even set to 0. However, this forms yet another feedback loop in the system. Another, more cautious approach, may clip the lean contribution of the second integrator to a fixed value. One aspect of this clip is that it does not halt the second integrator, in contrast to a typical anti-windup approach. If the second integrator's output is limited due to lean limit considerations, the second integrator can still correct the disturbance that has occurred, and if necessary extend the time that the second integrator acts. By clipping the output, but allowing the integrator to continue to update and provide a correction of a longer duration, the overall disturbance will be corrected over time. Thus in one example, a duration of corrective action of the second integrator is extended proportionally to a degree to which its output is clipped.

Figure 4:
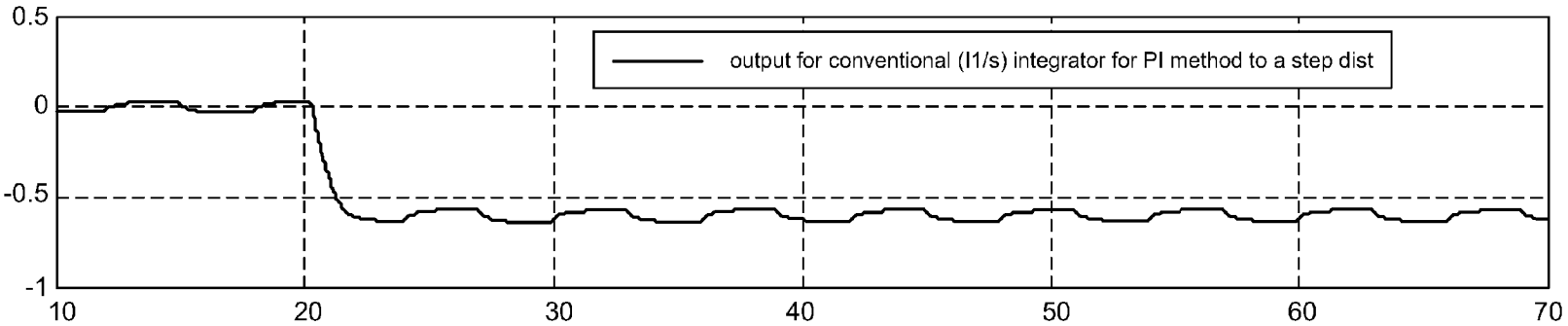
FIG. 4 shows an integrator output for a Smith Predictor PI controller for a step fuel disturbance.

Turning now to FIG. 4, additional sample data is provided to better illustrate the advantageous clipping that may optionally be used with the controller of FIG. 2B. Specifically, FIG. 4 shows the output of the controller in FIG. 2A (no extra integrator) to a step disturbance (at 20 seconds). In the case of the FIG. 2B system (I&PI), the response of the extra integrator I2/s is shown in the top plot and the integrator I1/s of the PI controller is shown in the bottom plot of FIG. 5.

Figure 5:
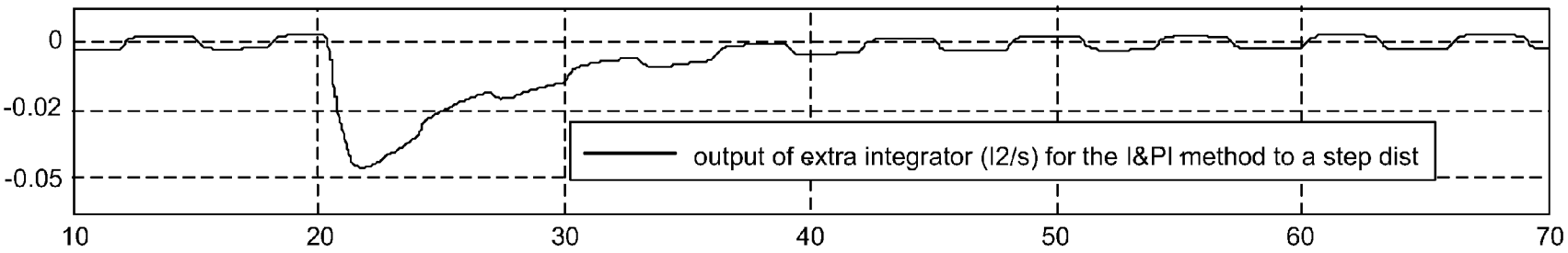
FIG. 5 shows the output of each integrator of the inner loop fuel control system shown in FIG. 2B.
Figure 5:
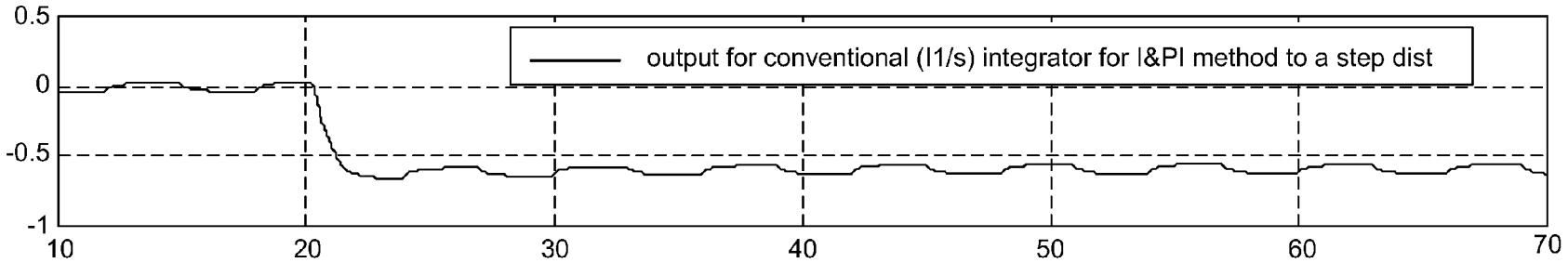

Turning now to FIG. 5, the integrator (I1/s) of the bottom plot of FIG. 5 matches the integrator output of FIG. 4. The deviation of the integrator I2/s from 0 in the top plot f FIG. 5 is the initial portion of the disturbance that was not countered by the conventional controller. Essentially, the integrator (I2/s) removes the cumulative effect of the disturbance that slipped through the original controller due to its limitation (such as sensing delay). This output of the I2 integrator can be clipped to 0.01 FAR, in one example.

Figure 6:
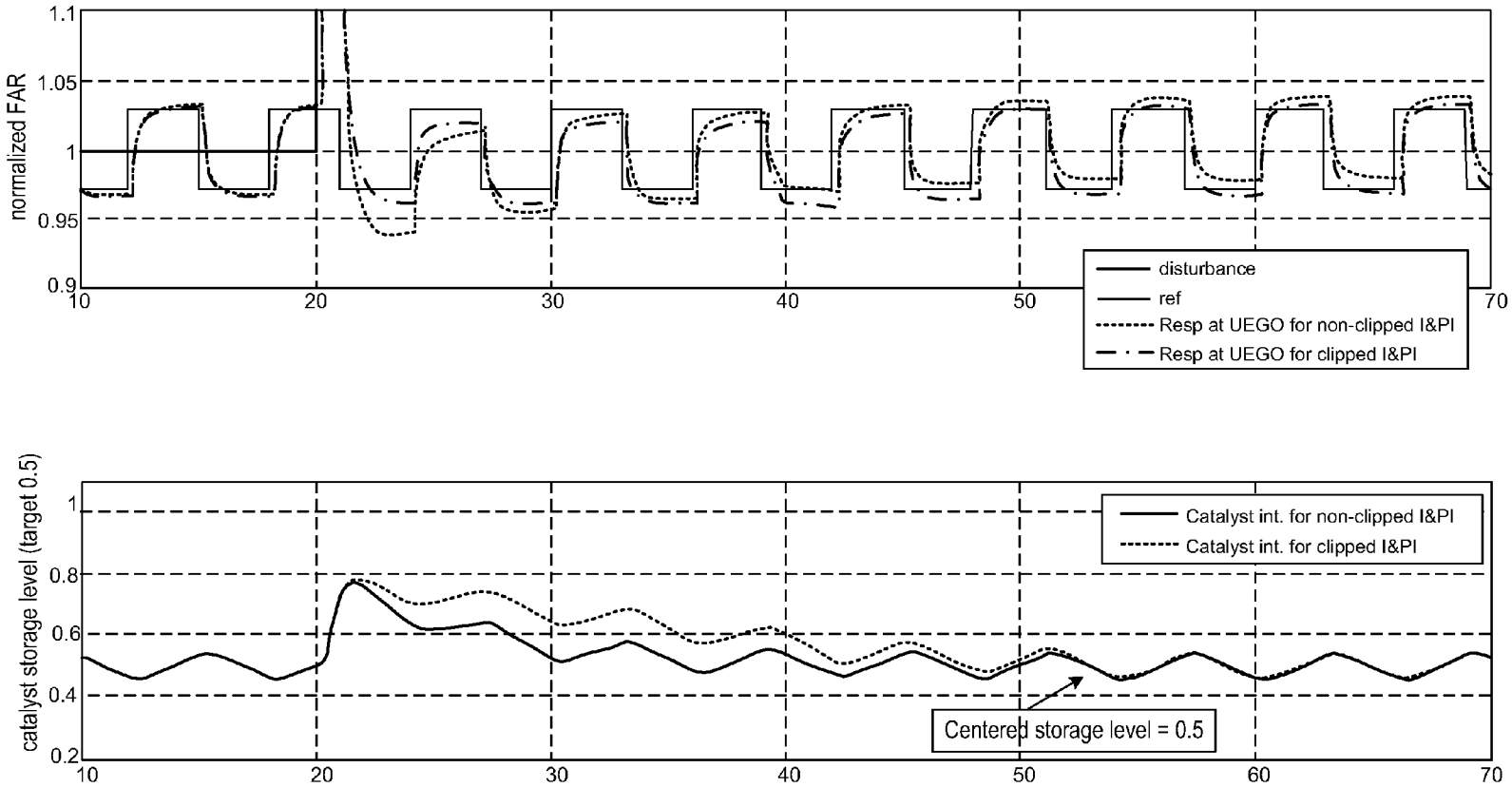
FIG. 6 shows the responses of systems to the inner loop fuel control system shown in FIG. 2B with and without a clip on the I2 integrator.

Turning now to FIG. 6, it shows the overall response. By setting the maximum lean extra integrator (I2/s) limit to −0.01 FAR, the response to the square wave reference is only allowed to deviate from the square wave by 0.01, as can be seen in the top plot of FIG. 6. In the lower plot of FIG. 6, the extra integrator with a clipped output (dotted line) counters the disturbance but takes longer than the non-clipped example (solid line).

A final consideration in terms of the additional integral operation of FIG. 2B is to take account of the catalyst state based on the HEGO measurement. Due to a build-up over time of small errors integrating the UEGO signal, it is possible that the catalyst state reaches either a very lean or very rich condition, threatening break-through (NOx if oxygen storage is saturated, HC and CO if oxygen storage is depleted). If such a condition is reached, then any additional control action the additional integrator makes that would further force the catalyst bias to be depleted or saturated should be reduced. If the HEGO voltage reaches a limit that suggests the catalyst is near break-through, the additional integrator should be halted in the direction that furthers the saturation/depletion. For example, if the oxygen storage is substantially full as indicated by the downstream sensor voltage reaching a threshold lower limit, then additional enleaning output of the second integrator is halted, but not clipping or otherwise altering enriching outputs. Alternatively, if the oxygen storage is substantially depleted as indicated by the downstream sensor voltage reaching a threshold upper limit, then additional enriching outputs of the second integrator are halted, but not altering or otherwise clipping enleaning outputs. In this way, it is possible to reduce inadvertent catalyst breakthrough, while still providing corrective action under non-break-through conditions.

Turning to FIG. 7 a flowchart of a method 700 is shown as one example embodiment of the controller of FIG. 2B. In the approach illustrated in FIG. 7, the clipping of the second integrator is illustrated. Specifically, at 702, the method includes determining a reference set-point (e.g., via 202) for the inner loop based on the error of the outer loop. Next, at 704, the method determines the error (e.g., via the summation block 240). Next, in 706, the method determines the second integrator's output with one or more clips applied. Additional details of block 706 are described via the method of FIG. 8.

Then, the error is added to the clipped output of the second integrator, among other elements, and applied to the Smith Predictor at 708, including compensation via the filter 214. Next, the output of the Smith Predictor is used to generate proportional and integral terms (710 and 712, respectively) that are then added and applied to generate closed loop fuel adjustments of fueling based on airflow at 714. The determined adjustment is then applied, via the fuel injector, at 716.

Additional details of the clips of 706 are illustrated via the example method 800 in FIG. 8. Specifically, FIG. 8 shows a method 800 of clipping output of the second integrator 209 of FIG. 2B. The "1/z" block (814) indicates a last pass memory element that may be used for discrete time integration, with z representing the discrete time domain operator. The example measurements and set points assume normalized FAR, where high HEGO voltage indicates rich, and low voltage indicates lean state.

The method 800 includes determining the second integrator's output term with clips. First, in 802, the method includes applying the error from the output of the summation 240 with an integral gain 808 to multiplication block 810. In parallel, the method determines, at 806, a modification to the error value depending on the state of the downstream HEGO voltage (HEGO_volt) compared with rich and lean thresholds (rich_volt, lean_volt, respectively). The output of 806 multiplies at 810 to generate a modified integral error. If the HEGO and error condition indicate that the catalyst is in fact approaching breakthrough, the 806 output will be 0, which will effectively halt the integrator (I2/s). If the logic does not indicate an imminent catalyst break through, then 806 outputs the time since the last update of the control loop, typically a fraction of a second. The product at 810, which is the error multiplied by the integral gain 808 and the output from 806, will be the modified integral error input to the summation block 812. Blocks 812 and 814 provide the numerical integration of I2/s. Note that even though blocks 816 to 822 could clip the output at block 826, the memory location at 814 will continue to update.

Next, at 816, the method determines if the modified integral error (int) is smaller than a lean limit and if so (true) will clip the output to the lean limit in block 818. If the integrated value is not less than the lean limit (false) then block 820 checks if the integral term is greater than a rich limit an and if so (true), clips the output to the rich limit at 822. If neither clip is reached (false at 820), then the output is set to the modified integral term, which is then provided as an additional reference input to the Smith Predictor inner loop controller.

In this way, it is possible to adjust fuel injection via a fuel controller comprising an anticipatory controller responsive to exhaust oxygen feedback of an exhaust gas sensor positioned upstream of an exhaust catalyst, the anticipatory controller including a first integral term in the anticipatory controller and a second integral term, the second integral term correcting for past fuel disturbances, an output of the second integral term only partially forming a reference set-point of the anticipatory controller. As explained herein, this anticipatory controller and second integral term may be included within an inner loop of a controller having an inner and outer loop, the outer loop responsive to the downstream sensor and the inner loop responsive to the upstream sensor, the outer loop determining a set-point reference for the inner loop.

Further, as described with regard to FIG. 8, the output of the second integrator may be clipped based on various parameters, including based on lean and rich engine combustion limits as described in 816 and 820, based on downstream sensor voltage as described in 806, and various others. In some examples, the fuel corrections generated by the second integrator may be clipped based on exhaust gas oxygen sensor readings downstream of the exhaust catalyst, including suspending the output by setting the error to zero responsive to the downstream exhaust gas oxygen sensor reading being already biased from stoichiometry in the same direction as corrections generated by the second integrator at illustrated in 806.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

adjusting engine fuel injection by adjusting a signal sent to a fuel injector from an anticipatory controller responsive to feedback from an exhaust gas oxygen sensor positioned upstream of an exhaust catalyst, the anticipatory controller including first and second integral terms, the adjustment to the signal comprising correcting the second integral term for a past fuel disturbance and clipping the second integral term based on a plurality of engine torque correction limits.

2. The method of claim 1 wherein the second integral term maintains an exhaust fuel-air ratio entering the exhaust catalyst to be stoichiometric over a time-integrated average, even responsive to a one-sided disturbance.

3. The method of claim 2 wherein the anticipatory controller is a Smith Predictor.

4. The method of claim 3 wherein the first integral term is included in the Smith Predictor.

5. The method of claim 1 further comprising suspending a fuel correction generated by the second integral term based on an exhaust gas oxygen sensor reading of an exhaust gas oxygen sensor that is located downstream of the exhaust catalyst.

6. The method of claim 5 wherein the fuel correction is suspended if the downstream exhaust gas oxygen sensor reading is already biased from a desired stoichiometry in a same direction as the correction generated by the second integral term.

7. The method of claim 1 further comprising adjusting a reference set-point of the anticipatory controller responsive to engine speed and load.

8. The method of claim 1 wherein an inner loop reference set-point is modulated at a frequency.

9. The method of claim 7 wherein the reference set-point is a desired catalyst oxygen storage state between fully saturated with oxygen and fully depleted with oxygen.

10. An engine method, comprising:

adjusting fuel injection to an engine by adjusting a signal sent to a fuel injector from a fuel controller comprising an anticipatory controller responsive to exhaust oxygen feedback of an exhaust gas oxygen sensor positioned upstream of an exhaust catalyst, the anticipatory controller including a first integral term and a second integral term, wherein adjusting the signal comprises correcting the second integral term for a past fuel disturbance, an output of the second integral term only partially forming a reference set-point of the anticipatory controller, and clipping the second integral term based on a plurality of engine torque correction limits.

11. The method of claim 10 wherein the fuel controller comprises an inner loop and an outer loop.

12. The method of claim 11 wherein the outer loop determines a set-point reference for the inner loop.

13. The method of claim 12 wherein the anticipatory controller is a Smith Predictor.

14. The method of claim 12 wherein adjusting the signal sent to the fuel injector further comprises suspending a fuel correction generated by the second integral term based on an exhaust gas oxygen sensor reading of an exhaust gas oxygen sensor that is located downstream of the exhaust catalyst.

15. The method of claim 14 wherein the fuel correction is suspended responsive to the downstream exhaust gas oxygen sensor reading being already biased from a desired stoichiometry in a same direction as the correction generated by the second integral term.

16. A system, comprising:

an engine including an exhaust passage and a fuel injector;

a catalyst arranged along the exhaust passage;

an upstream UEGO sensor coupled upstream of the catalyst in the exhaust passage; and a downstream HEGO sensor coupled downstream of the catalyst in a controller including memory with computer readable instructions stored therein, the instructions including code for determining corrections to a pulsewidth of fuel injected by the fuel injector based on feedback from the upstream UEGO sensor and downstream HEGO sensor via an inner and an outer loop, and injecting fuel to the engine via the fuel injector in proportion to the corrected pulsewidth, where the inner loop includes an integrator and an anticipatory controller, and where only a portion of a set-point reference fed to the anticipatory controller is formed by the integrator of the inner loop, and wherein the memory further includes computer readable instructions stored therein including code for clipping an output of an integral term based on a sign of an error of the inner loop relative to whether the downstream HEGO sensor indicates lean or rich, including clipping the integral term based on a plurality of engine torque correction limits.

17. The system of claim 16 wherein the catalyst is a three-way catalyst.

* * * * *